United States Patent [19]

Froment

[11] Patent Number: 4,557,298

[45] Date of Patent: Dec. 10, 1985

[54] DOBBIES INCORPORATING DOUBLE SWINGING LEVERS FOR WEAVING LOOMS

[75] Inventor: Jean-Paul Froment, Doussard, France

[73] Assignee: S.A. des Etablissements Staubli, Faverges, France

[21] Appl. No.: 588,167

[22] Filed: Mar. 9, 1984

[30] Foreign Application Priority Data

Mar. 22, 1983 [FR] France ..... 83 04883

[51] Int. Cl.[4] ..... D03C 1/06

[52] U.S. Cl. ..... 139/71

[58] Field of Search ..... 139/65, 68, 71, 72, 139/196.2

[56] References Cited

U.S. PATENT DOCUMENTS

| | | | |
|---|---|---|---|
| 2,644,488 | 7/1953 | Pfarrwaller | 139/71 |
| 3,140,731 | 7/1964 | Jones | 139/196.2 |
| 3,441,060 | 4/1969 | Schwarz | 139/71 |
| 4,154,268 | 5/1979 | Schwarz | 139/68 |

*Primary Examiner*—Henry S. Jaudon

*Attorney, Agent, or Firm*—Dowell & Dowell

[57] ABSTRACT

The present invention relates to dobbies incorporating double swinging levers for weaving looms. In order to simplify the construction of the reading device in the case of synchronized dobbies capable of operating both in reverse motion and in forward motion, there is associated with each selection hook a releasable retaining member which immobilizes it in one or the other of two stable positions of operation, so that the reading device need exert only a fleeting action (pulse) on one or the other of two heels of the hook, whereby no sustained action of the reading device is necessary.

5 Claims, 5 Drawing Figures

DOBBIES INCORPORATING DOUBLE SWINGING LEVERS FOR WEAVING LOOMS

The present invention relates to dobbies of the type incorporating double swinging levers used for forming the shed in weaving looms, and it relates more particularly to the arrangement of the selection hooks interposed in these systems between each swinging lever and the reading device.

In dobbies of this type, each of the swinging levers is known to be provided at its ends with two coupling hooks adapted to cooperate with two selection hooks controlled by the reading device as a function of the weaving programme or design envisaged for the fabric being made. Each selection hook comprises two stable positions, one resulting from elastic means (springs) associated with said hook, whilst the other results from sustained action of the reading device. Such a system operates in entirely satisfactory manner as far as the conventional dobbies are concerned.

On the contrary, this is not so when it is desired to make so-called "synchronized" dobbies, i.e. dobbies capable of operating both in reverse motion (unweaving) and in forward motion (weaving). In fact, if the elastic means must provide in either direction one of the two stable positions of each selection hook, and if on the other hand the maintenance of the sustained action of the reading device must maintain the other stable position of the upper hook and the lower hook during operation in reverse motion than such a structure, renders the construction of the above-mentioned device highly complex. Now, it will be readily understood that this complexity is to the detriment of performance, reliability and cost of the reading device.

It is an object of the present invention to overcome this drawback and to produce a synchronized-type dobby incorporating double swinging levers, which is of simple and reliable construction.

The invention resides essentially in associating with each selection hook a retaining member cooperating with elastic return means and adapted, under the effect of an action exerted fleetingly by the reading device on said retaining member and/or on the hook itself, to immobilize the latter in one or the other of the two usual stable positions of operation.

It will be readily understood that the retaining member with which each of the selection hooks of the dobby is provided performs, in fact, the role of an active memory which ensures maintenance of said hook in the position allocated thereto and which consequently dispenses with the need for a sustained action of the reading device. The construction of the latter is therefore considerably simplified, since a fleeting action or pulse exertable in both directions of operation of the dobby on one and the other of the two selection hooks associated with each swinging lever is obviously easier to effect than a sustained action. In particular, reading devices of the electromagnetic type may be employed, which are capable of easily furnishing fleeting pulses.

The invention will be more readily understood on reading the following description with reference to the accompanying drawings, in which.

Figure 1:
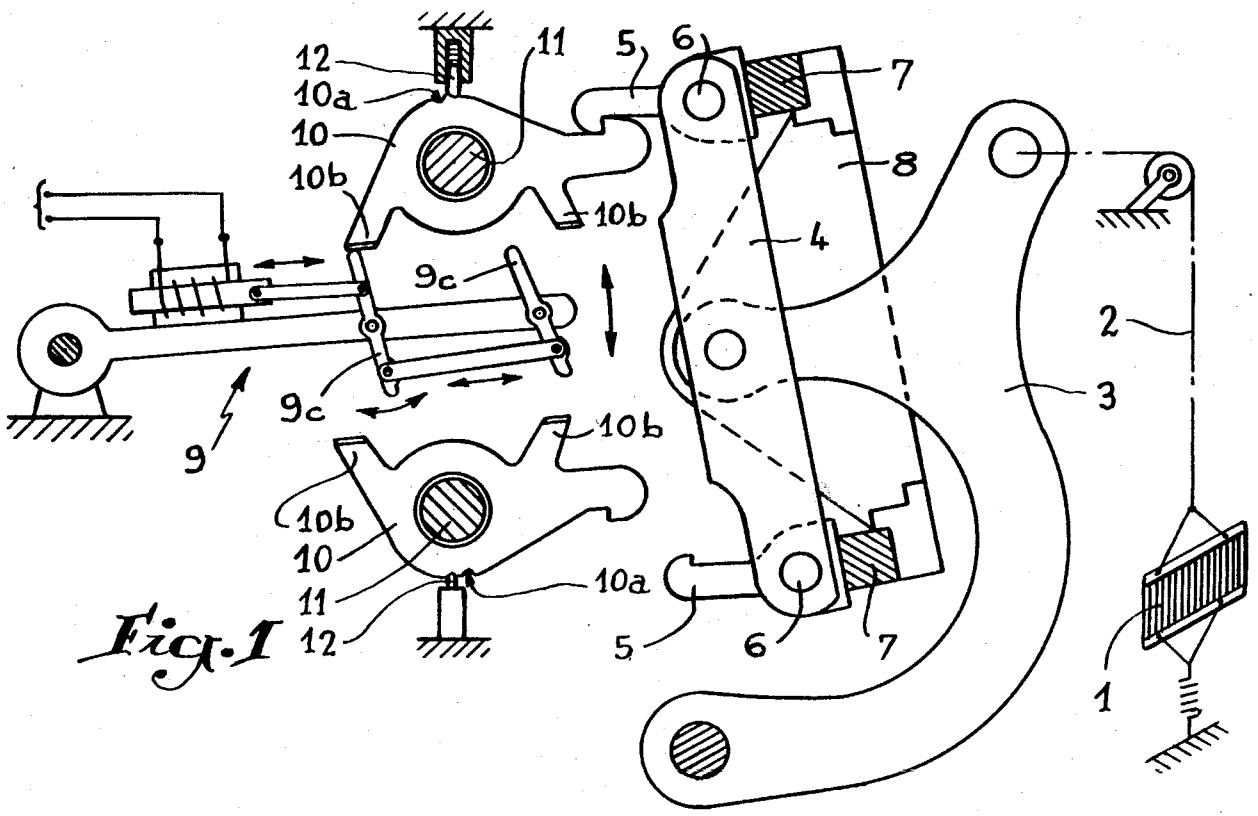
FIG. 1 is a diagramatic transverse section showing the general arrangement of one of the elements for actuating a dobby incorporating double swinging levers equipped with selection hooks according to the invention.

Referring now to the drawings, FIG. 1 schematically shows one of the heddle frames 1 of a weaving loom associated with the dobby in question. This frame 1 is connected, for example by a cable 2, to an actuating lever 3 on which pivots a double swinging lever 4 provided at its ends with coupling hooks 5 articulated at 6. Against the rear heel of each hook 5 acts a cross-piece or pusher 7 which a rocking lever 8 actuates with an oscillating movement, in synchronism with the displacement of the weft-passing member of the loom and the batten thereof.

This arrangement is conventional and therefore does not need to be described in greater detail. It suffices to recall that, between the coupling hooks 5 of each swinging lever 4 and a dobby reading device 9 (which is not considered novel per se for purposes of this disclosure), are interposed two selection hooks 10 articulated on fixed pins 11. Each of these selection hooks 10 is controlled by the reading device 9 in order to position the selection hook 10, at the opportune moment determined by the weaving programme with which said device is equipped, to lie on the oscillating path of the corresponding coupling hook 5 or, on the contrary, to be retracted therefrom, thus controlling, in combination with the control of the opposite hook 10, the actuating lever 3 associated with the heddle frame 1.

According to the invention, each selection hook 10 comprises, in addition to a main body designated by reference 10, releasable retaining means or pawl adapted to form a memory to ensure immobilization of the corresponding hook 10 either in a stable engaging position for which its nose lies on the path of the nose of the coupling hook 5 (see upper hook 10 in FIG. 1), or in stable "retracted" position for which said noses cannot cooperate with one another (see the lower hook 10).

In FIG. 1, each retaining member is constituted by a detent finger 12 which, under the effect of a spring, slides in a small sleeve fixed to the frame of the dobby, so that it free end comes into elastic enggagement in one or the other of two widened recesses **10*a* made side by side in the edge of body 10. It will further be observed that each selection hook 10 includes two heels 10*b* disposed on either side of the pivot pin 11 and oriented towards the reading device 9, and it is against one or the other of these heels 10*b* that the mobile members 9*c* of said reading device act. In FIGS. 2 through 5 these mobile members are presented by arrow 9*a***.

It will be appreciated that the action exerted by the device 9 on the heels **10*b* may be fleeting, i.e. provided by a simple pulse of brief duration, since the detent finger 12 retains the body 10 of the section hook in question in the position to which said body has been brought by the mobile pushing members 9*a*. The device 9 is thus capable of ensuring control of the two selection hooks of each element actuating the dobby, in either of the two directions of operation (weaving or unweaving), without it being necessary to resort to a delicate and complicated construction, and this due to the simply fleeting nature of the action of the members 9*a* on the heels 10*b***.

Figure 2:
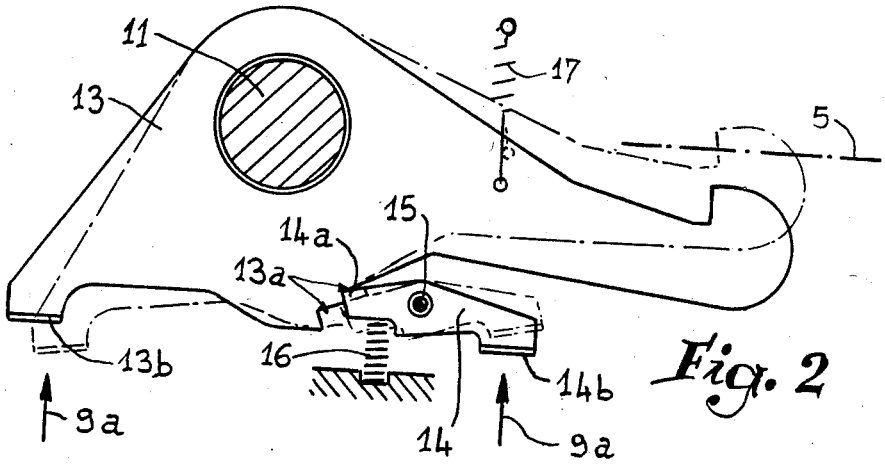
FIGS. 2 to 5 are partial transverse sections, on a larger scale, illustrating four modified embodiments of a selection hook.

FIG. 2 illustrates a modified embodiment whereby there is associated with each selection hook, here referenced 13, a retaining member constituted by a rocking pawl 14 borne by a fixed pin 15. Under the effect of a spring 16, the nose **14*a* of this pawl 14 cooperates with one or the other of two shoulders 13***a* made on the opposite edge of the body of the hook 13 in order to immobilize the latter at one or the other of two different angular orientations.

In this case, the mobile members of the reading device act fleetingly alternately on a heel 13*b* of the body of the hook 13 and on a heel 14*b* of the pawl 14. In this latter case, the body of the hook 13 rocks under the effect of elastic means constituted by a spring 17.

Figure 3:
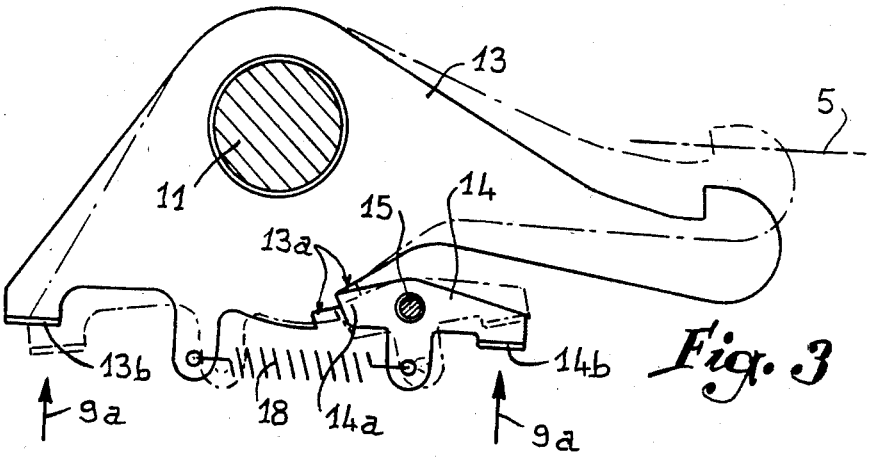

FIG. 3 shows an embodiment very similar to that of FIG. 2. The two springs 16 and 17 are replaced by a single spring referenced 18, whose ends are respectively attached to the body of the hook 13 and to the pawl 14. Otherwise, operation is identical.

Figure 4:
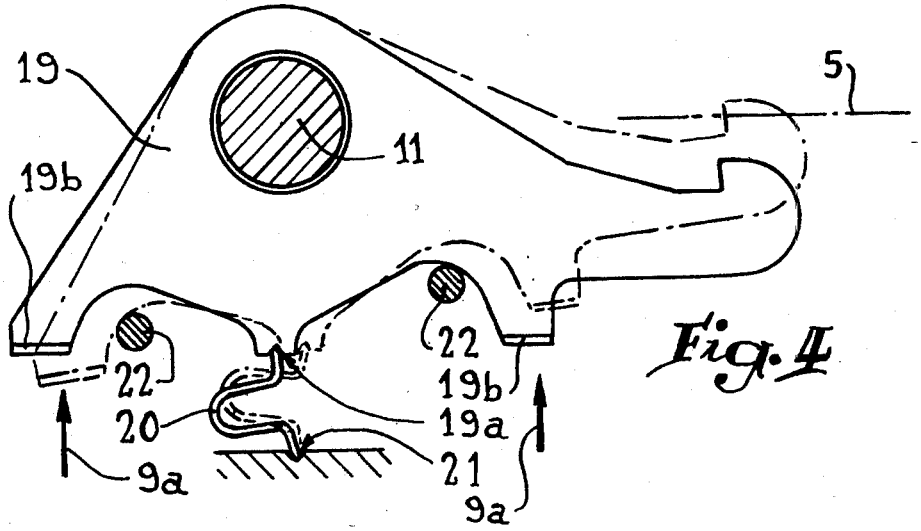

In the modified embodiment illustrated in FIG. 4, the member for elastically retaining the hook, here referenced 19, in one and the other of the two stable positions of operation thereof, is in the form of an elastically deformable blade 20 clamped in the longitudinal direction between a support 19*a* on the body of the hook 19 and a fixed support 21, so as to perform the role of a compression spring.

It will be readily understood that this blade 20 tends to toggle the hook 19 and bring it into one or the other of two stable positions for which points 11, 19*a* and 21 are not in alignment. Stability of the positions is ensured by two fixed stops 22; as in FIG. 1, the fleeting action of the reading device is exerted selectively on one or the other of two heels 19*b* provided on the body of the hook 19 on either side of the pivot pin 11.

Figure 5:
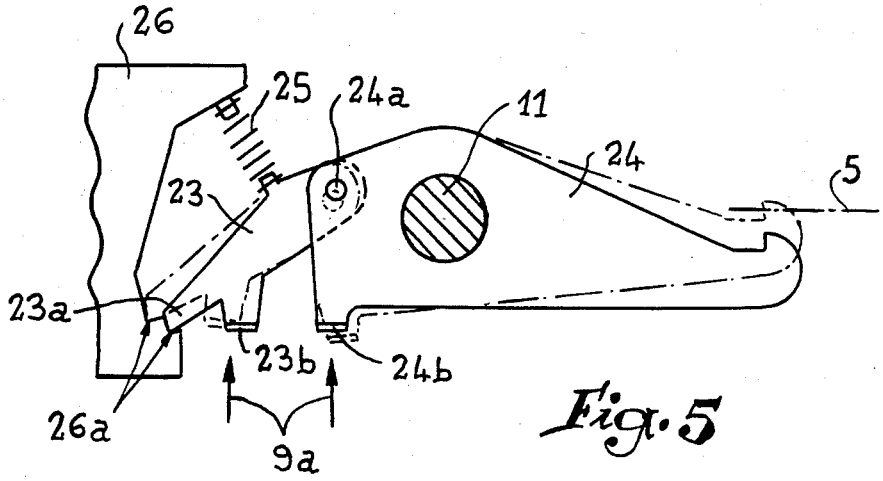

It will be appreciated that other embodiments may be imagined for the retaining member or "memory" associated with each selection hook. As illustrated in FIG. 5, this member or memory may be constituted in particular by a rocking pawl 23 which is articulated on a transverse pin 24*a* directly borne by the body of the retaining hook 24; the nose 23*a* of this pawl 23, permanently stressed by a spring 25, cooperates with two shoulders 26*a* made in the opposite edge of a fixed part 26, the fleeting action of the reading device being exerted selectively against one or the other of twl heels 23*b* and 24*b* respectively provided on said pawl 23 and on the body of the hook 24.

It must, moreover, be understood that the foregoing description has been given only by way of example and that it in no way limits the domain of the invention which would not be exceeded by replacing the details of execution described by any other equivalents. In particular, it goes without saying that the invention is applicable to dobbies of the type incorporating "drawn" double swinging levers in which the selection hooks are borne by a balance arm animated by an oscillating movement by the loom, said balance arm taking the place of the rocking lever 8 of the embodiment illustrated in FIG. 1, corresponding to the case of a dobby incorporating "pushed" double swinging levers.

What is claimed is:

1. In a weaving-loom dobby of the type having a fixed frame and having multiple actuating levers attached to associated heddles and carrying rocking levers each having two spaced coupling hooks, and the dobby having for each coupling hook a selection hook means including a hook body pivotally supported by a pin carried by said fixed frame and including a hook nose for engaging a coupling hook, each selection hook means being displaceable by a pattern reading device between a coupling-hook engaging position and a retracted position, improved dobby structure comprising:

heel means associated with each selection hook means and contactable by the reading device to pivot said body and displace it between said positions;

and releasable retaining means coupled between said fixed frame and the body of each selection hook means and operative to stably retain the selection hook body in whichever of said positions the reading device last displaced it and until displaced thereby to a different position, each releasable retaining means comprising a pawl rockably carried by the fixed frame and having a nose, and said body of the selection hook having shoulder means thereon engageable by said pawl nose, and elastic means yieldably urging the hook body to pivot into one position and urging the pawl nose against a shoulder means in the other position, whereby to releasably retain the body in the other position when displaced thereinto.

2. A dobby as claimed in claim 1, wherein said elastic means comprises a common spring stretched between the body and the pawl.

3. A dobby as claimed in claim 1, wherein the heel means associated with each selection hook means comprises two heels, one located on the body, and the other located on the pawl and operative when contacted by the reading device to displace the pawl and release the pawl nose from the shoulder.

4. A dobby as claimed in claim 1, wherein each releasable retaining means comprises a pawl rockably carried on the selecting hook body and having a nose, a fixed part carried on the fixed frame and having shoulder means thereon engageable by said pawl nose, and elastic means extending from the fixed part to the pawl and yieldably urging the hook body to pivot into one position, and urging the pawl nose against a shoulder means in the other position whereby to releasably retain the body in the other position when displaced thereinto.

5. A dobby as claimed in claim 4, wherein the heel means associated with each selection hook means comprises two heels, one located on the body, and the other located on the pawl and operative when contacted by the reading device to displace the pawl and release the pawl nose from the shoulder.

* * * * *